US011707930B2

(12) United States Patent
Takabe et al.

(10) Patent No.: US 11,707,930 B2
(45) Date of Patent: Jul. 25, 2023

(54) PIEZOELECTRIC DEVICE, LIQUID EJECTING HEAD, AND LIQUID EJECTING APPARATUS

(71) Applicant: Seiko Epson Corporation, Tokyo (JP)

(72) Inventors: Motoki Takabe, Shiojiri (JP); Masaki Mori, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/512,917

(22) Filed: Oct. 28, 2021

(65) Prior Publication Data

US 2022/0134754 A1 May 5, 2022

(30) Foreign Application Priority Data

Oct. 30, 2020 (JP) ..... 2020-182235

(51) Int. Cl.
*B41J 2/14* (2006.01)
*B41J 2/16* (2006.01)
*B41J 2/045* (2006.01)

(52) U.S. Cl.
CPC ..... *B41J 2/14233* (2013.01); *B41J 2/04541* (2013.01); *B41J 2/161* (2013.01); *B41J 2/1623* (2013.01)

(58) Field of Classification Search
None
See application file for complete search history.

(56) References Cited

U.S. PATENT DOCUMENTS 9,090,063 B2 7/2015 Torimoto et al.
2014/0253641 A1* 9/2014 Furuya ..... B41J 2/14201 310/365
2015/0231884 A1* 8/2015 Kobayashi ..... B41J 2/1628 29/25.35

FOREIGN PATENT DOCUMENTS

JP 2017-074798 4/2017

* cited by examiner

*Primary Examiner* — Erica S Lin
(74) *Attorney, Agent, or Firm* — Workman Nydegger

(57) ABSTRACT

A piezoelectric device includes a diaphragm provided on a side of one surface of a substrate, and a piezoelectric actuator having a first electrode, a piezoelectric body layer, and a second electrode which are stacked in a first direction on a side of a surface opposite to the substrate of the diaphragm, in which when one area far from an end portion of the second electrode is a first area and one area near the end portion of the second electrode is a second area, of two areas of the second electrode in a second direction intersecting the first direction, the second electrode has a stiffness of 17,000 N/m or more in the second area in the first direction, which is higher than a stiffness in the first area in the first direction, and a length in the second area in the first direction is equal to or less than a length of the piezoelectric body layer in the second area in the first direction.

11 Claims, 9 Drawing Sheets

PIEZOELECTRIC DEVICE, LIQUID EJECTING HEAD, AND LIQUID EJECTING APPARATUS

The present application is based on, and claims priority from JP Application Serial Number 2020-182235, filed Oct. 30, 2020, the disclosure of which is hereby incorporated by reference herein in its entirety.

BACKGROUND

1. Technical Field

The present disclosure relates to a piezoelectric device, a liquid ejecting head, and a liquid ejecting apparatus including a diaphragm and a piezoelectric actuator having a first electrode, a piezoelectric body layer, and a second electrode.

2. Related Art

A typical example of a liquid ejecting head, which is one of the piezoelectric devices, is an ink jet recording head that ejects ink droplets. It is known that the ink jet recording head includes, for example, a flow path forming substrate in which a pressure chamber communicating with a nozzle is formed, and a piezoelectric actuator provided on the side of one surface of the flow path forming substrate via a diaphragm, and an ink droplet is ejected from a nozzle by causing a pressure change in the ink in the pressure chamber by the piezoelectric actuator.

It is known that the piezoelectric actuator includes a first electrode formed on the diaphragm, a piezoelectric body layer formed of a piezoelectric material having electromechanical conversion characteristics on the first electrode, and a second electrode provided on the piezoelectric body layer. In the piezoelectric actuator having this configuration, there is a concern that cracks, burnout, or the like may occur in the piezoelectric body layer due to the bending deformation of the piezoelectric body layer. Various configurations of the piezoelectric actuators have been proposed for the purpose of suppressing the occurrence of such defects (see, for example, JP-A-2017-074798).

In JP-A-2017-074798, a configuration is disclosed in which the piezoelectric element extends from a position corresponding to the opening portion of the pressure chamber to a position on the outside beyond the opening edge of the pressure chamber, and in a portion in which the piezoelectric body layer extends to a position on the outside of the pressure chamber, the piezoelectric body layer has an exposed portion from which a second electrode is excluded, and the exposed portion of the piezoelectric body layer is covered with an adhesive.

With such a configuration, it is possible to suppress the occurrence of cracks, burnout, or the like in the piezoelectric body layer.

However, even with the above configuration, it is difficult to completely suppress the occurrence of cracks and burnout in the piezoelectric body layer in the vicinity of the end portion of the second electrode extending to the outside of the pressure chamber. In the area in which the bending deformation of the piezoelectric body layer is inhibited by extending to the outside of the pressure chamber, of the piezoelectric body layer to which the voltage is applied, strain occurs in the active portion that the second electrode overlaps, but strain does not occur in the inactive portion that the second electrode does not overlap.

Accordingly, defects such as cracks and burnout are likely to occur in the vicinity of the boundary portion between the active portion and the inactive portion of the piezoelectric body layer, that is, the end portion of the second electrode. In particular, when the drive pulse supplied from the electrode to the piezoelectric body layer has a high frequency, the strain operation of the active portion has a high frequency, and thus defects such as cracks and burnout are likely to occur at the boundary portion.

Such a problem is not limited to the liquid ejecting head represented by the ink jet recording head that ejects ink, and is also present in other piezoelectric devices in a similar manner.

SUMMARY

According to an aspect of the present disclosure, a piezoelectric device includes a substrate on which a plurality of recess portions are formed, a diaphragm provided on a side of one surface of the substrate, and a piezoelectric actuator having a first electrode, a piezoelectric body layer, and a second electrode which are stacked in a first direction on a side of a surface opposite to the substrate of the diaphragm, in which when one area far from an end portion of the second electrode is a first area and one area near the end portion of the second electrode is a second area, of two areas of the second electrode in a second direction intersecting the first direction, the second electrode has a stiffness of 17,000 N/m or more in the second area in the first direction, which is higher than a stiffness in the first area in the first direction, and a length in the second area in the first direction is equal to or less than a length of the piezoelectric body layer in the second area in the first direction.

According to another aspect of the present disclosure, a liquid ejecting head includes a substrate on which a plurality of recess portions are formed, a diaphragm provided on a side of one surface of the substrate, and a piezoelectric actuator having a first electrode, a piezoelectric body layer, and a second electrode which are stacked in a first direction on a side of a surface opposite to the substrate of the diaphragm, in which when one area far from an end portion of the second electrode is a first area and one area near the end portion of the second electrode is a second area, of two areas of the second electrode in a second direction intersecting the first direction, the second electrode has a stiffness of 17,000 N/m or more in the second area in the first direction, which is higher than a stiffness in the first area in the first direction, and a length in the second area in the first direction is equal to or less than a length of the piezoelectric body layer in the second area in the first direction.

According to still another aspect of the present disclosure, a liquid ejecting apparatus includes the liquid ejecting head.

DESCRIPTION OF EXEMPLARY EMBODIMENTS

Figure 1:
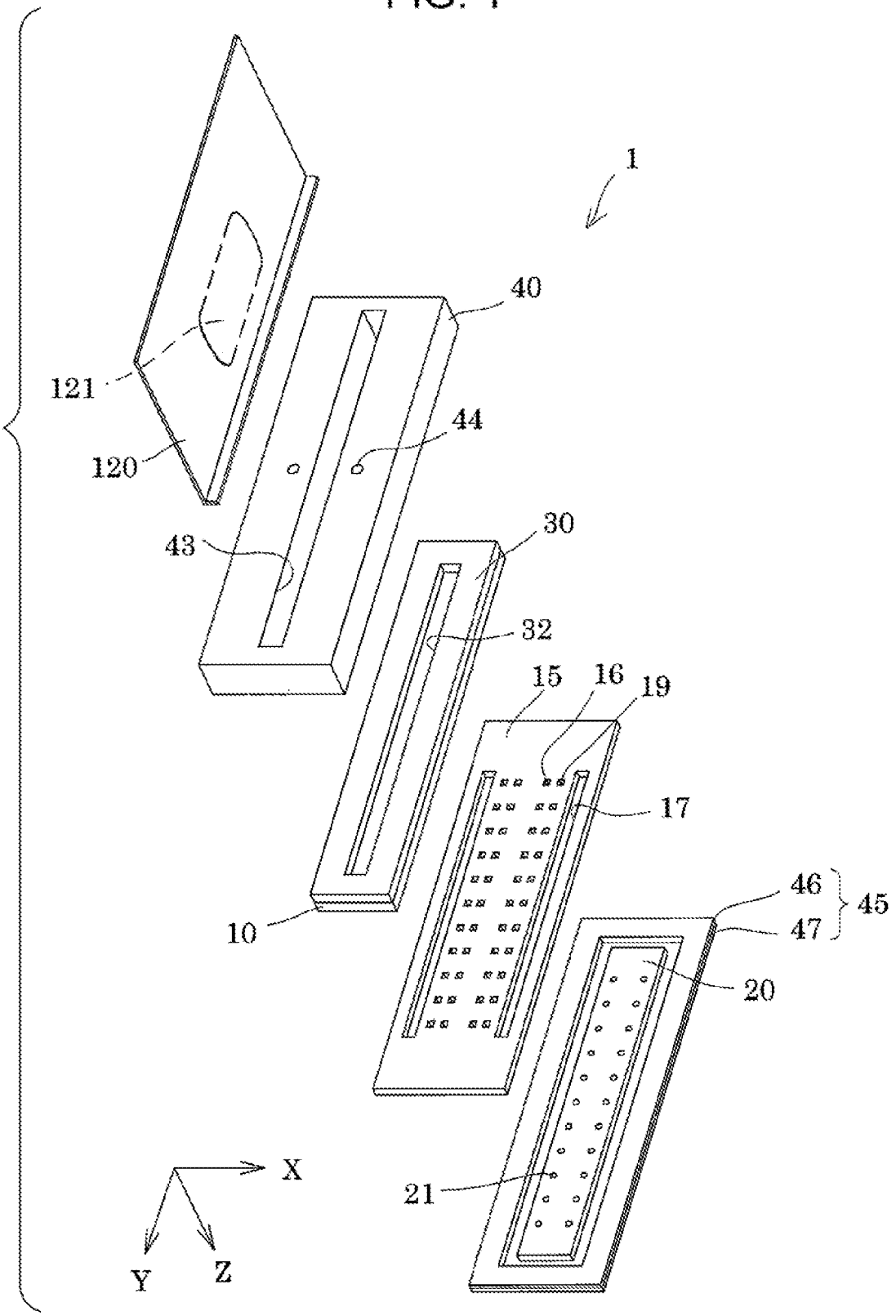
FIG. 1 is an exploded perspective view of a recording head according to a first embodiment.

Hereinafter, the present disclosure will be described in detail based on embodiments. However, the following description is a description in regard to one aspect of the present disclosure, and the configuration of the present disclosure can be optionally changed within the scope of the disclosure. In each figure, the same members are designated by the same reference numerals, and redundant descriptions will be omitted.

Further, in each figure, X, Y, and Z represent three spatial axes that are orthogonal to each other. In the present specification, the directions along these axes are the X direction, the Y direction, and the Z direction. The direction in which the arrow in each figure points is the positive (+) direction, and the opposite direction of the arrow is the negative (−) direction. Further, the Z direction indicates a vertical direction, the +Z direction indicates a vertically downward direction, and the −Z direction indicates a vertically upward direction. Further, the three X, Y, and Z spatial axes that do not limit the positive direction and the negative direction will be described as the X axis, the Y axis, and the Z axis.

First Embodiment

Figure 2:
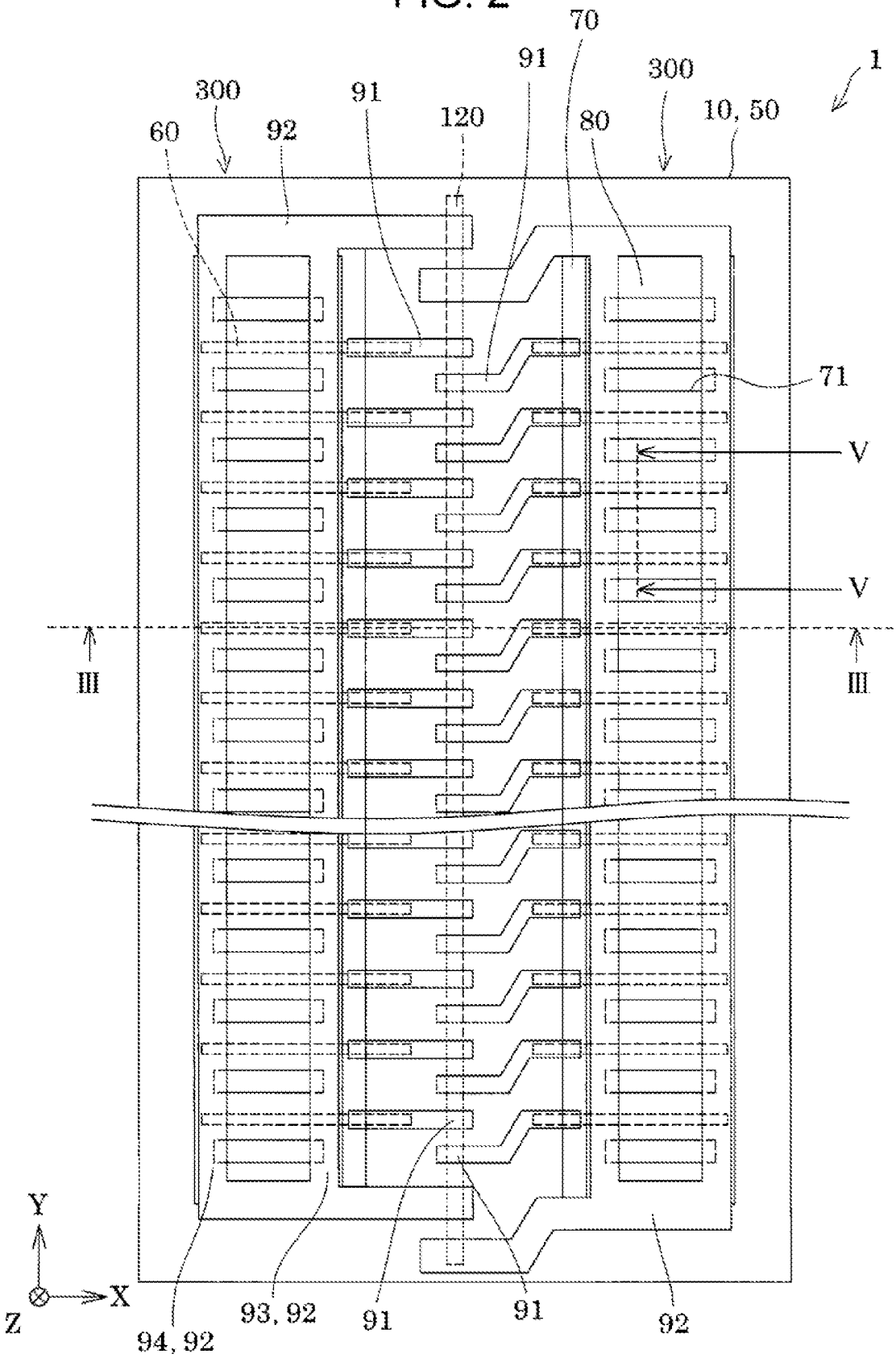
FIG. 2 is a plan view of a recording head according to the first embodiment.
Figure 3:
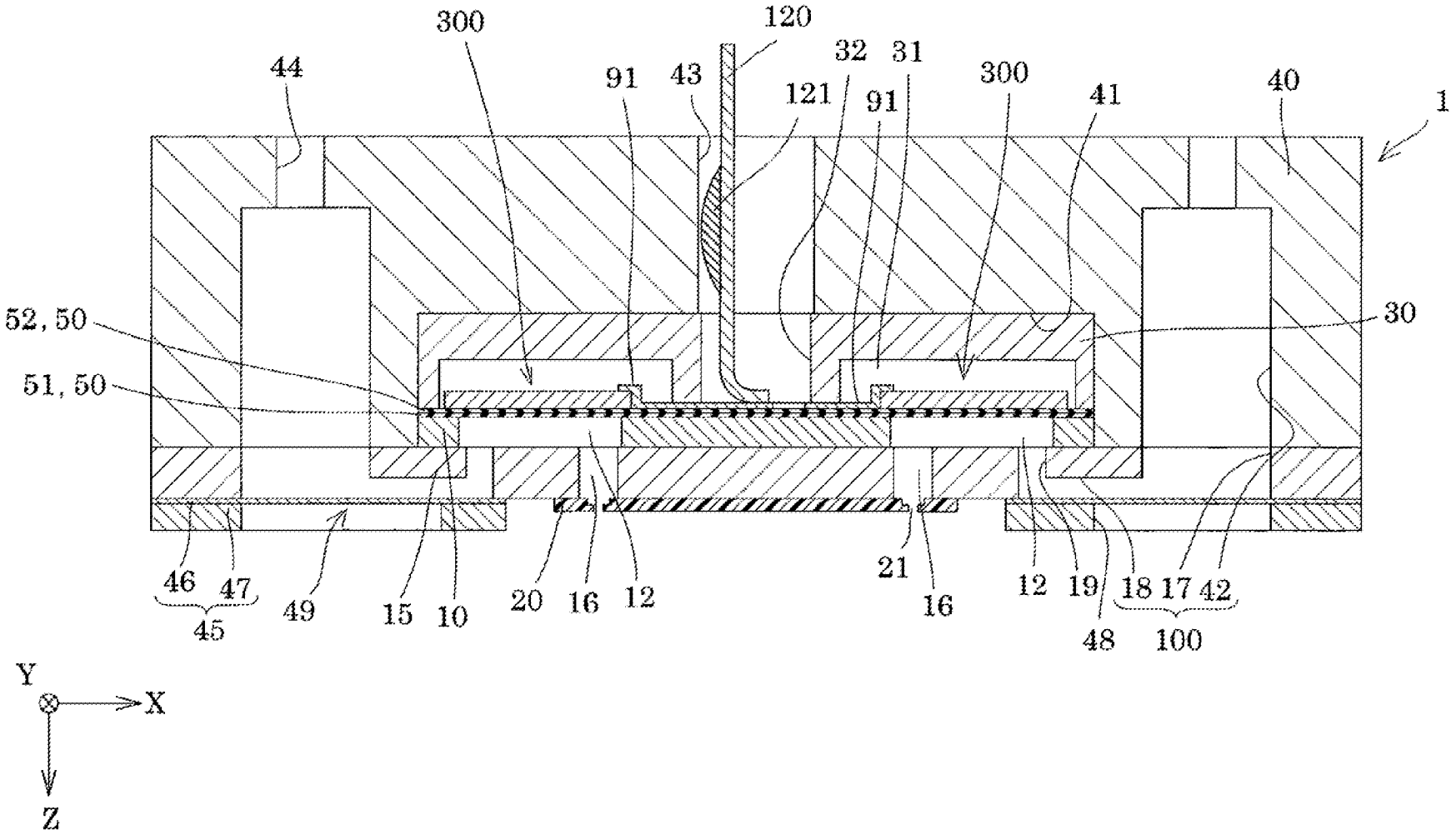
FIG. 3 is a sectional view of a recording head according to the first embodiment.
Figure 4:
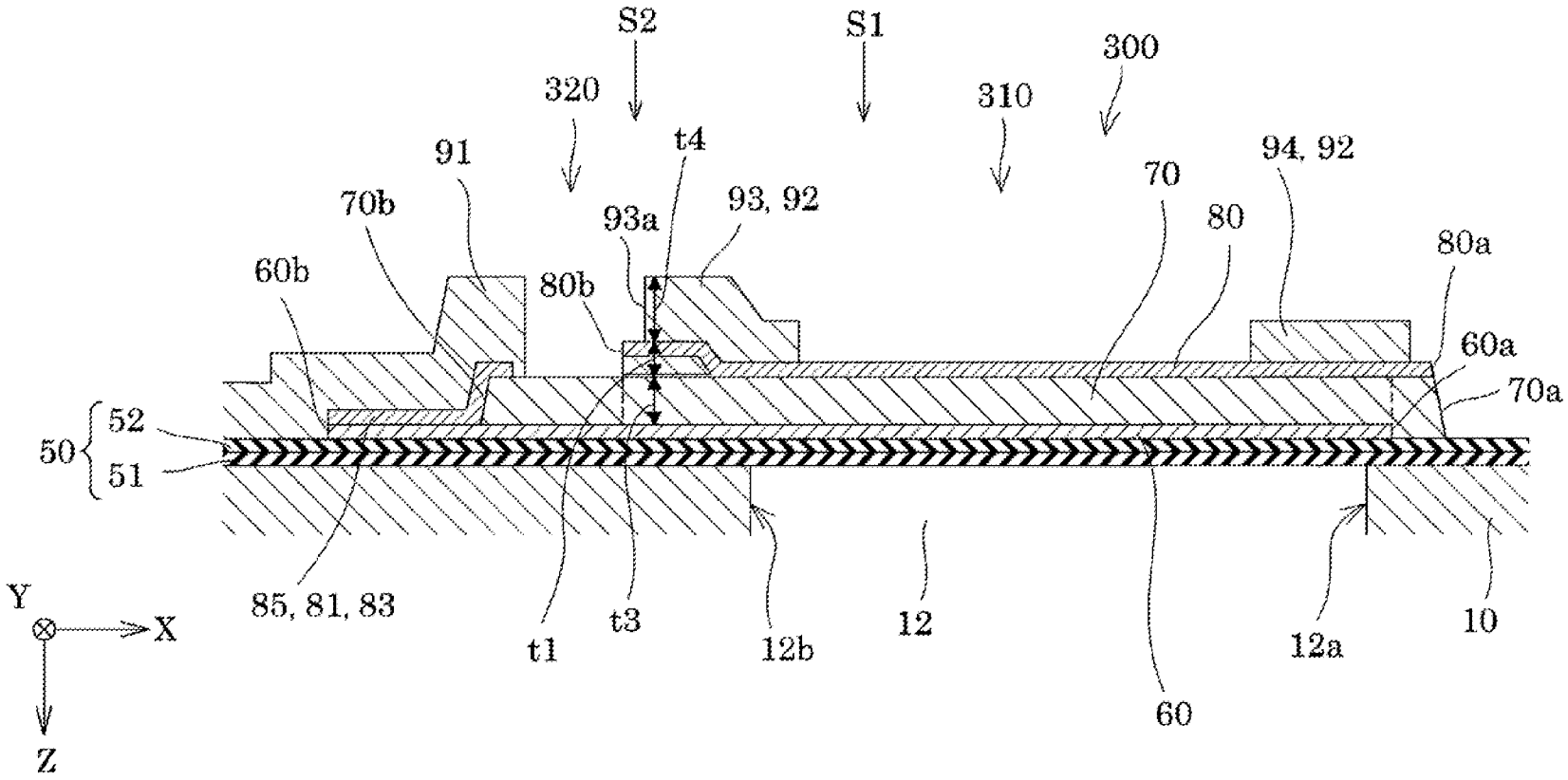
FIG. 4 is a sectional view of a main portion of the recording head according to the first embodiment.
Figure 5:
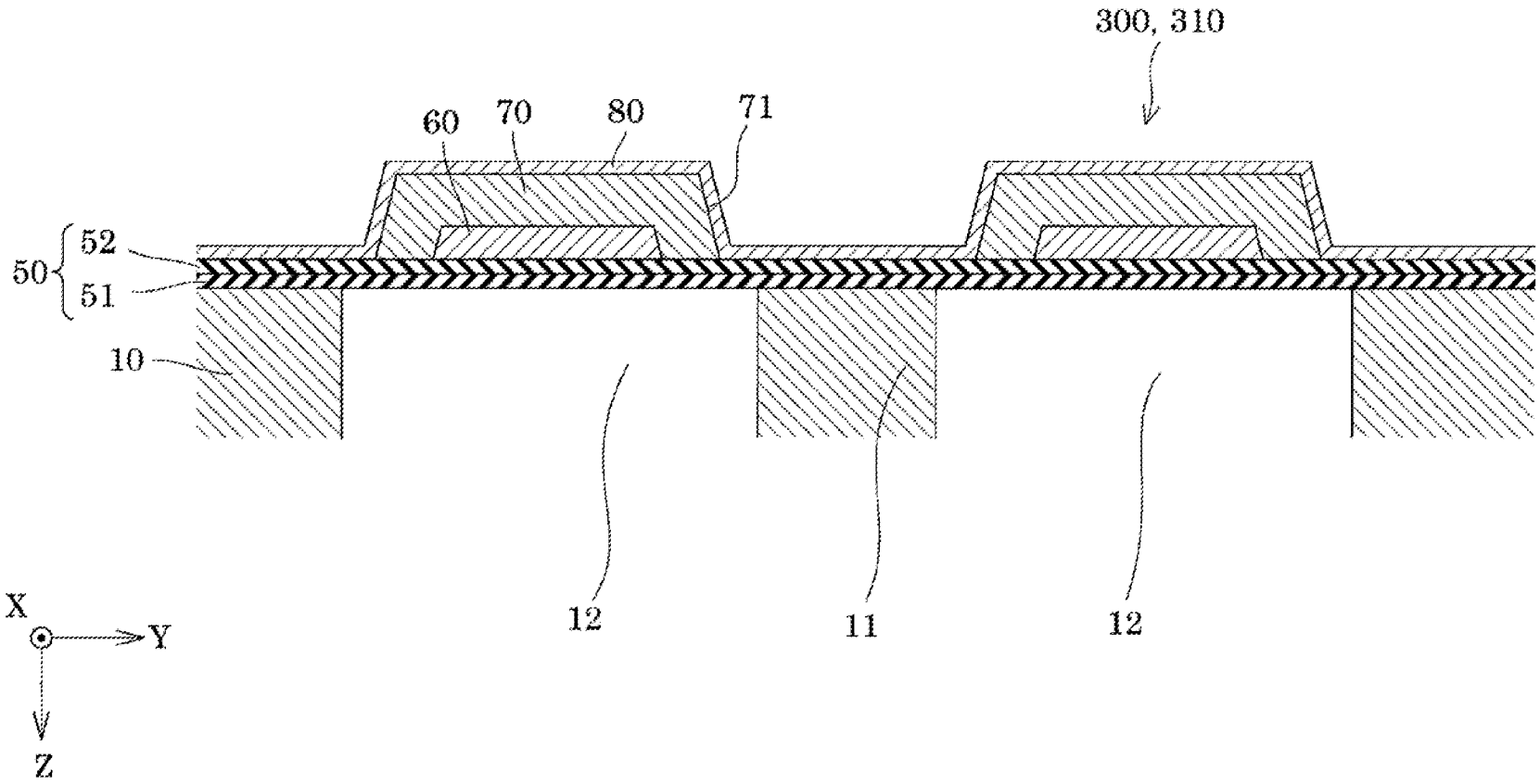
FIG. 5 is a sectional view of the recording head according to the first embodiment.
Figure 6:
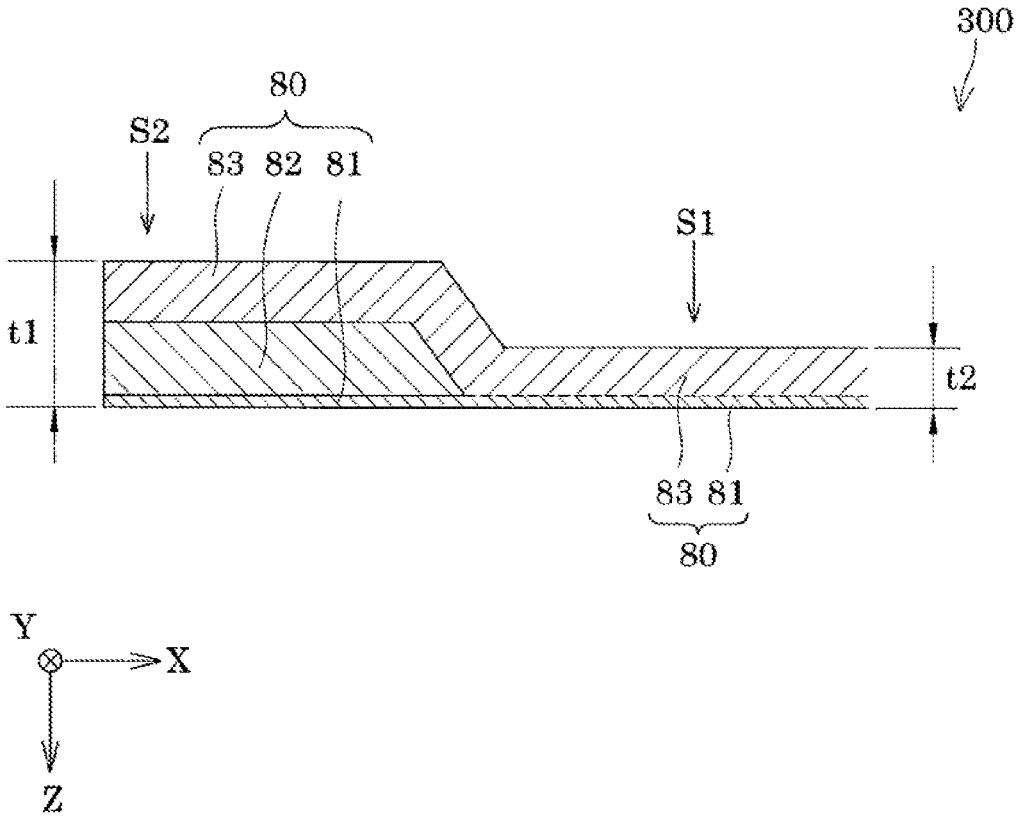
FIG. 6 is a sectional view of a main portion of a second electrode according to the first embodiment.

FIG. 1 is an exploded perspective view of an ink jet recording head which is an example of a liquid ejecting head according to a first embodiment of the present disclosure. FIG. 2 is a plan view of the recording head. FIG. 3 is a sectional view taken along the line III-III of FIG. 2, FIG. 4 is an enlarged view of the piezoelectric actuator portion in FIG. 3, and FIG. 5 is a sectional view taken along the line V-V of FIG. 2, and an enlarged view of the piezoelectric actuator portion. Further, FIG. 6 is an enlarged sectional view illustrating a main portion of a second electrode.

As illustrated in the figure, an ink jet recording head (hereinafter, also simply referred to as a recording head) 1, which is an example of the liquid ejecting head of the present embodiment, ejects ink droplets in the Z-axis direction, which is the first direction, and more specifically, in the +Z direction.

The ink jet recording head 1 includes a flow path forming substrate 10 as an example of the substrate. The flow path forming substrate 10 is made of, for example, a silicon substrate, a glass substrate, an SOI substrate, various ceramic substrates, or the like. The flow path forming substrate 10 may be a substrate with (100) plane preferential orientation or a substrate with (110) plane preferential orientation.

On the flow path forming substrate 10, a plurality of pressure chambers 12 are disposed in two rows in the X-axis direction, which is the second direction intersecting the Z-axis direction, which is the first direction. That is, the plurality of pressure chambers 12 constituting each row are disposed along the Y-axis direction, which is a third direction intersecting the X-axis direction.

The plurality of pressure chambers 12 constituting each row are disposed on a straight line along the Y-axis direction so that the positions in the X-axis direction are in the same position. The pressure chambers 12 adjacent to each other in the Y-axis direction are partitioned by a partition wall 11. Of course, the disposition of the pressure chamber 12 is not particularly limited. For example, the disposition of the plurality of pressure chambers 12 lined up in the Y-axis direction may be a so-called staggered disposition in which each pressure chamber 12 is positioned shifted in the X-axis direction every other pressure chamber 12.

Further, the pressure chamber 12 of the present embodiment is formed in a rectangular shape, for example, in which the length in the X-axis direction is longer than the length in the Y-axis direction in plan view from the +Z direction. Of course, the shape of the pressure chamber 12 in plan view from the +Z direction is not particularly limited, and may be a parallel quadrilateral shape, a polygonal shape, a circular shape, an oval shape, or the like. The oval shape referred to here refers to a shape in which both end portions in the longitudinal direction are semicircular shapes based on a rectangular shape, and includes a rectangular shape with rounded corners, an elliptical shape, an egg shape, or the like.

A communication plate 15, a nozzle plate 20, and a compliance substrate 45 are sequentially stacked on the side of the +Z direction of the flow path forming substrate 10.

The communication plate 15 is provided with a nozzle communication passage 16 that communicates the pressure chamber 12 and a nozzle 21. Further, the communication plate 15 is provided with a first manifold portion 17 and a second manifold portion 18 that form a portion of a manifold 100 that serves as a common liquid chamber with which the plurality of pressure chambers 12 communicate. The first manifold portion 17 is provided to penetrate the communication plate 15 in the Z-axis direction. Further, the second manifold portion 18 is provided to open on the surface on the side of the +Z direction without penetrating the communication plate 15 in the Z-axis direction.

Further, the communication plate 15 is provided with a supply communication passage 19 communicating with one end portion of the pressure chamber 12 in the X-axis direction independently of each of the pressure chambers 12. The supply communication passage 19 communicates the second manifold portion 18 with each of the pressure chambers 12, and supplies the ink in the manifold 100 to each pressure chamber 12.

As the communication plate 15, a silicon substrate, a glass substrate, an SOI substrate, various ceramic substrates, a metal substrate, or the like can be used. Examples of the metal substrate include a stainless steel substrate or the like. It is preferable that the communication plate 15 uses a material having a thermal expansion coefficient substantially the same as that of the flow path forming substrate 10. As a result, when the temperatures of the flow path forming substrate 10 and the communication plate 15 change, the warpage of the flow path forming substrate 10 and the communication plate 15 due to the difference in the thermal expansion coefficient can be suppressed.

The nozzle plate 20 is provided on the opposite side of the communication plate 15 of the flow path forming substrate 10, that is, on the surface on the side of the +Z direction. In the nozzle plate 20, the nozzle 21 is formed communicating with each pressure chamber 12 via the nozzle communication passage 16.

In the present embodiment, a plurality of nozzles 21 are disposed side by side to form a row along the Y-axis direction. The nozzle plate 20 is provided with two nozzle rows in the X-axis direction in which the plurality of nozzles 21 are arranged in a row. That is, the plurality of nozzles 21 in each row are disposed so that the positions in the X-axis direction are in the same position. The disposition of the nozzle 21 is not particularly limited. For example, the nozzles 21 disposed side by side in the Y-axis direction may be disposed at positions shifted in the X-axis direction every other nozzle 21.

The material of the nozzle plate 20 is not particularly limited, and for example, a silicon substrate, a glass substrate, an SOI substrate, various ceramic substrates, and a metal substrate can be used. Examples of the metal substrate include a stainless steel substrate or the like. Further, as the material of the nozzle plate 20, an organic substance such as a polyimide resin can be used. However, it is preferable to use a material for the nozzle plate 20 that has substantially the same thermal expansion coefficient as the thermal expansion coefficient of the communication plate 15. As a result, when the temperatures of the nozzle plate 20 and the communication plate 15 change, the warpage of the nozzle plate 20 and the communication plate 15 due to the difference in the thermal expansion coefficient can be suppressed.

The compliance substrate 45 is provided together with the nozzle plate 20 is provided on the opposite side of the communication plate 15 of the flow path forming substrate 10, that is, on the surface on the side of the +Z direction. The compliance substrate 45 is provided around the nozzle plate 20 and seals the openings of the first manifold portion 17 and the second manifold portion 18 provided in the communication plate 15. In the present embodiment, the compliance substrate 45 includes a sealing film 46 made of a flexible thin film and a fixed substrate 47 made of a hard material such as metal. The area of the fixed substrate 47 facing the manifold 100 is an opening portion 48 completely removed in the thickness direction. Accordingly, one surface of the manifold 100 is a compliance portion 49 sealed only by the flexible sealing film 46.

On the other hand, on the opposite side of the nozzle plate 20 or the like of the flow path forming substrate 10, that is, on the surface on the side of the −Z direction, the diaphragm 50 and a piezoelectric actuator 300 that bends and deforms the diaphragm 50 to cause a pressure change in the ink inside the pressure chamber 12, which will be described in detail later, are provided. FIG. 3 is a view for explaining the overall configuration of the recording head 1, and illustrates the configuration of the piezoelectric actuator 300 in a simplified manner.

A protective substrate 30 having substantially the same size as the flow path forming substrate 10 is further bonded to the surface of the flow path forming substrate 10 on the side of the −Z direction with an adhesive or the like. The protective substrate 30 has a holding portion 31 which is a space for protecting the piezoelectric actuator 300. The holding portions 31 are independently provided for each row of the piezoelectric actuators 300 disposed side by side in the Y-axis direction, and are formed two side by side in the X-axis direction. Further, the protective substrate 30 is provided with a through hole 32 penetrating in the Z-axis direction between two holding portions 31 disposed side by side in the X-axis direction.

Further, on the protective substrate 30, a case member 40 for defining a manifold 100 communicating with the plurality of pressure chambers 12 together with the flow path forming substrate 10 is fixed. The case member 40 has substantially the same shape as the communication plate 15 described above in plan view, and is bonded to the protective substrate 30 and also bonded to the communication plate 15 described above.

Such case member 40 has an accommodating portion 41, which is a space having a depth configured to accommodate the flow path forming substrate 10 and the protective substrate 30, on the side of the protective substrate 30. The accommodating portion 41 has an opening area wider than the surface of the protective substrate 30 bonded to the flow path forming substrate 10. The opening surface of the accommodating portion 41 on the side of the nozzle plate 20 is sealed by the communication plate 15 in a state in which the flow path forming substrate 10 and the protective substrate 30 are accommodated in the accommodating portion 41.

Further, in the case member 40, third manifold portions 42 are defined on both of the outsides of the accommodating portion 41 in the X-axis direction. The manifold 100 of the present embodiment is constituted with the first manifold portion 17 and the second manifold portion 18 provided on the communication plate 15, and the third manifold portion 42. The manifold 100 is continuously provided in the Y-axis direction, and the supply communication passages 19 that communicate each of the pressure chambers 12 and the manifold 100 are disposed side by side in the Y-axis direction.

Further, the case member 40 is provided with an introduction port 44 for communicating with the manifold 100 and supplying ink to each manifold 100. Further, the case member 40 is provided with a coupling port 43 that communicates with the through hole 32 of the protective substrate 30 and through which a wiring substrate 120 is inserted.

In such recording head 1 of the present embodiment, ink is taken in from an introduction port 44 coupled to an external ink supply unit (not illustrated), the inside from the manifold 100 to the nozzle 21 is filled with the ink, and then according to the recording signal from a drive circuit 121, a voltage is applied to each of the piezoelectric actuators 300 corresponding to the pressure chamber 12. As a result, the diaphragm 50 bends and deforms together with the piezoelectric actuator 300, the pressure inside each of the pressure chambers 12 increases, and ink droplets are ejected from each of the nozzle 21.

Hereinafter, the configuration of the piezoelectric actuator 300 according to the present embodiment will be described. As described above, the piezoelectric actuator 300 is provided on the surface of the opposite side of the nozzle plate 20 of the flow path forming substrate 10 via the diaphragm 50.

As illustrated in FIGS. 4 to 6, the diaphragm 50 is constituted with an elastic film 51, which is made of silicon oxide, provided on the side of the flow path forming substrate 10, and an insulator film 52, which is made of a zirconium oxide film, provided on the elastic film 51. The liquid flow path of the pressure chamber 12 or the like is formed by anisotropic etching of the flow path forming substrate 10 from the surface on the side of the +Z direction, and the surface of the liquid flow path of the pressure chamber 12 or the like on the side of the −Z direction is constituted with the elastic film 51.

The configuration of the diaphragm 50 is not particularly limited. The diaphragm 50 may be constituted with, for example, either the elastic film 51 or the insulator film 52, and may further include other films other than the elastic film 51 and the insulator film 52. Examples of other film materials include silicon and silicon nitride.

The piezoelectric actuator 300 is a pressure generating unit for causing a pressure change in the ink inside the pressure chamber 12, and is also called a piezoelectric element. The piezoelectric actuator 300 includes a first electrode 60, a piezoelectric body layer 70, and a second electrode 80 that are sequentially stacked from the side of the +Z direction, which is the side of the diaphragm 50, to the side of the −Z direction. That is, the piezoelectric actuator 300 includes the first electrode 60, the piezoelectric body layer 70, the second electrode 80 which are sequentially stacked toward the side of the −Z direction along the Z-axis direction, which is the first direction with respect to the diaphragm 50 in the present embodiment.

In the piezoelectric actuator 300, a portion in which piezoelectric strain occurs in the piezoelectric body layer 70 when a voltage is applied between the first electrode 60 and the second electrode 80 is referred to as an active portion 310. On the other hand, a portion where the piezoelectric strain does not occur in the piezoelectric body layer 70 is referred to as an inactive portion 320. That is, in the piezoelectric actuator 300, the portion in which the piezoelectric body layer 70 is pinched between the first electrode 60 and the second electrode 80 is the active portion 310, and the portion in which the piezoelectric body layer 70 is not pinched between the first electrode 60 and the second electrode 80 is the inactive portion 320. Further, when the piezoelectric actuator 300 is driven, a portion that is actually displaced in the Z-axis direction is referred to as a flexible portion, and a portion that is not displaced in the Z direction is referred to as a non-flexible portion. That is, in the piezoelectric actuator 300, a portion that faces the pressure chamber 12 in the Z-axis direction is a flexible portion, and the outside portion of the pressure chamber 12 is a non-flexible portion.

Generally, one electrode of the active portion 310 is configured as an independent individual electrode for each active portion 310, and the other electrode is configured as a common electrode common to a plurality of active portions 310. In the present embodiment, the first electrode 60 is configured as an individual electrode, and the second electrode 80 is configured as a common electrode.

Specifically, the first electrode 60 constitutes an individual electrode that is separated for each pressure chamber 12 and is independent for each active portion 310. The first electrode 60 is formed to have a width narrower than the width of the pressure chamber 12 in the Y-axis direction. That is, in the Y-axis direction, the end portion of the first electrode 60 is positioned on the inside of the area facing the pressure chamber 12.

Further, an end portion 60*a* in the +X direction and an end portion 60*b* in the −X direction of the first electrode 60 are disposed on the outside of the pressure chamber 12, respectively. As illustrated in FIG. 4, the end portion 60*a* of the first electrode 60 in the +X direction is disposed at a position further in the +X direction than the end portion 12*a* of the pressure chamber 12 in the +X direction. The end portion 60*b* of the first electrode 60 in the −X direction is disposed at a position further in the −X direction than the end portion 12*b* of the pressure chamber 12 in the −X direction.

The material of the first electrode 60 is not particularly limited, but for example, a conductive material such as a metal such as iridium or platinum or a conductive metal oxide such as indium tin oxide abbreviated as ITO, is used.

The piezoelectric body layer 70 is made of a piezoelectric material of an oxide having a polarized structure formed on the first electrode 60, and can be made of, for example, a perovskite-type oxide represented by the general formula $ABO_3$. As the perovskite-type oxide used in the piezoelectric body layer 70, for example, a lead-based piezoelectric material containing lead, a lead-free piezoelectric material containing no lead, or the like can be used. The thickness of the piezoelectric body layer 70 is not particularly limited, but may be formed to be approximately 1 to 4 μm.

Further, as illustrated in FIG. 2, the piezoelectric body layer 70 is continuously provided in the Y-axis direction with a length in the X-axis direction as a predetermined length. That is, the piezoelectric body layer 70 has a predetermined thickness and is continuously provided along the side-by-side arrangement direction of the pressure chambers 12. Further, as illustrated in FIG. 4, the length of the piezoelectric body layer 70 in the X-axis direction is longer than the length of the pressure chamber 12 in the X-axis direction which is the longitudinal direction. Accordingly, on both sides of the pressure chamber 12 in the X-axis direction, the piezoelectric body layer 70 extends to the outside of the pressure chamber 12. As described above, the piezoelectric body layer 70 extends to the outside of the pressure chamber 12 in the X-axis direction, so that the strength of the diaphragm 50 is improved. Accordingly, when the active portion 310 is driven to displace the piezoelectric actuator 300, it is possible to suppress the occurrence of cracks or the like in the piezoelectric body layer 70.

Further, as illustrated in FIG. 4, an end portion 70*a* of the piezoelectric body layer 70 in the +X direction is positioned more outside compared to the end portion 60*a* of the first electrode 60. That is, the end portion 60*a* of the first electrode 60 in the +X direction is covered with the piezoelectric body layer 70. On the other hand, the end portion 70*b* of the piezoelectric body layer 70 in the −X direction is positioned more inside compared to an end portion 60*b* of the first electrode 60, and the end portion 60*b* of the first electrode 60 in the −X direction is not covered by the piezoelectric body layer 70.

As illustrated in FIGS. 2 and 5, the piezoelectric body layer 70 is formed with a groove portion 71 to correspond to each of the partition walls 11 and having a thickness thinner than the other areas. The groove portion 71 of the present embodiment is formed by completely removing the piezoelectric body layer 70 in the Z-axis direction. That is, the fact that the piezoelectric body layer 70 has a portion having a thickness thinner than the other areas includes the one in which the piezoelectric body layer 70 is completely removed in the Z-axis direction. Of course, the piezoelectric body layer 70 may be formed thinner than the other portions on the bottom surface of the groove portion 71.

Further, the length of the groove portion 71 in the Y-axis direction, that is, the width of the groove portion 71 is the same as or wider than the width of the partition wall 11. In the present embodiment, the width of the groove portion 71 is wider than the width of the partition wall 11.

Such groove portion 71 is formed to have a rectangular shape in plan view from the side of the −Z direction. Of course, the shape of the groove portion 71 in plan view from the side of the −Z direction is not limited to a rectangular shape, and may be a polygonal shape of pentagon or more, a circular shape, an elliptical shape, or the like.

By providing the groove portion 71 in the piezoelectric body layer 70, the stiffness of the portion of the diaphragm 50 facing the end portion of the pressure chamber 12 in the Y-axis direction, that is, the so-called arm portion of the diaphragm 50 is suppressed, and thus the piezoelectric actuator 300 can be displaced more satisfactorily.

As illustrated in FIGS. 4 and 5, the second electrode 80 is provided on the side of the −Z direction which is the opposite side of the first electrode 60 of the piezoelectric body layer 70, and is configured as a common electrode common to the plurality of active portions 310. The second electrode 80 is continuously provided in the Y-axis direction with a length in the X-axis direction as a predetermined length. The second electrode 80 is also provided on the inner surface of the groove portion 71, that is, on the side surface of the groove portion 71 of the piezoelectric body layer 70, and on the insulator film 52 which is the bottom surface of the groove portion 71. Regarding the inside of the groove portion 71, the second electrode 80 may be provided only on a portion of the inner surface of the groove portion 71, or may not be provided over the entire surface of the inner surface of the groove portion 71.

Further, as illustrated in FIG. 4, an end portion 80*a* of the second electrode 80 in the +X direction is disposed more outside compared to the end portion 60*a* of the first electrode 60 in the +X direction covered with the piezoelectric body layer 70. That is, the end portion 80*a* of the second electrode 80 in the +X direction is positioned more outside compared to the end portion 12*a* of the pressure chamber 12 in the +X direction, and more outside compared to the end portion 60*a* of the first electrode 60 in the +X direction. In the present embodiment, the end portion 80*a* of the second electrode 80 in the +X direction substantially coincides with the end portion 70*a* of the piezoelectric body layer 70. Accordingly, the end portion of the active portion 310 in the +X direction, that is, the boundary between the active portion 310 and the inactive portion 320 is defined by the end portion 60*a* of the first electrode 60.

On the other hand, the end portion 80*b* of the second electrode 80 in the −X direction is disposed more outside compared to the end portion 12*b* of the pressure chamber 12 in the −X direction, but is disposed more inside compared to the end portion 70*b* of the piezoelectric body layer 70 in the X-axis direction. As described above, the end portion 70*b* of the piezoelectric body layer 70 in the −X direction is positioned more inside compared to the end portion 60*b* of the first electrode 60. Accordingly, the end portion 80*b* of the second electrode 80 in the −X direction is positioned on the piezoelectric body layer 70 more inside compared to the end portion 60*b* of the first electrode 60 in the −X direction. Accordingly, there is present a portion in which the surface of the piezoelectric body layer 70 is exposed on the outside of the end portion 80*b* of the second electrode 80 in the −X direction.

As described above, since the end portion 80*b* of the second electrode 80 in the −X direction is disposed on the side of the +X direction compared to the piezoelectric body layer 70 and the end portion of the first electrode 60 in the −X direction, the end portion of the active portion 310 in the −X direction, that is, the boundary between the active portion 310 and the inactive portion 320 is defined by the end portion 80*b* of the second electrode 80 in the −X direction.

In the portion in which the boundary between the active portion 310 and the inactive portion 320 is defined by the end portion 80*b* of the second electrode 80 and the surface of the piezoelectric body layer 70 is exposed in the inactive portion 320, defects such as cracks and burnout are likely to occur in the piezoelectric body layer 70.

In the present disclosure, when one area far from the end portion of the second electrode 80 is a first area S1 and one area near the end portion of the second electrode 80 is a second area S2, of two areas of the second electrode 80 in the X-axis direction, the second electrode 80 has a stiffness of 17,000 N/m or more in the Z-axis direction in the second area S2, which is higher than the stiffness in the Z-axis direction in the first area S1, and the length thereof in the Z-axis direction in the second area S2 is formed to be equal to or less than the length of the piezoelectric body layer 70 in the Z-axis direction in the second area S2.

Specifically, the first area S1 and the second area S2 are the following areas. The first area S1 is an area positioned in a driving area in which the diaphragm 50 is in contact with the pressure chamber 12 which is a recess portion. The second area S2 is an area positioned in a non-driving area in which the diaphragm 50 is not in contact with the pressure chamber 12. That is, the first area S1 is the area inside the pressure chamber 12, preferably in the vicinity of the center portion of the pressure chamber 12 in the X-axis direction, and the second area S2 is the area outside the end portion 12*b* of the pressure chamber 12 in the −X direction, preferably in the vicinity of the end portion 80*b* of the second electrode 80. The second area S2 includes the end portion 80*b* of the second electrode 80.

In the present embodiment, the stiffness of the second electrode 80 in the Z-axis direction in the second area S2 which is the vicinity of the end portion 80*b* in the −X direction is made to be higher than the stiffness of the second electrode 80 in the Z-axis direction in the first area S1 which is an area in the vicinity of the center portion of the pressure chamber 12. With such a configuration, the stiffness of the second electrode 80 in the Z-axis direction in the second area S2 is partially increased to exceed a predetermined value, and the occurrence of defects in the piezoelectric body layer 70 is suppressed without inhibiting the displacement of the piezoelectric actuator 300.

As illustrated in FIGS. 4 and 6, the second electrode 80 in the first area S1 has a first layer 81 continuous with respect to the piezoelectric body layer 70 in the Z-axis direction. Further, the second electrode 80 in the second area S2 has the first layer 81 extending from the first area S1, and a second layer 82 which is provided continuously in the Z direction with respect to the first layer 81 and has a lower electrical conductivity than the first layer 81. Further, the second electrode 80 in the second area S2 further has a third layer 83 which is continuously provided with respect to the second layer 82 in the Z direction and has an electrical conductivity than that of the second layer 82. The third layer 83 is provided not only over the second area S2 but also over the entire first layer 81, and the second electrode 80 in the first area S1 is constituted with the first layer 81 and the third layer 83. Accordingly, a thickness t1 of the second electrode 80 in the second area S2 is thicker than a thickness t2 of the second electrode 80 in the first area S1.

The material of the first layer 81 and the third layer 83 is not particularly limited, but similarly to the first electrode 60, for example, a conductive material such as a metal such as iridium or platinum or a conductive metal oxide such as indium tin oxide, is preferably used. The material of the second layer 82 may be lower in electrical conductivity than that of the first layer 81, but is preferably an insulator. Specific examples include tantalum oxide, which is abbreviated as $TiO_x$ and $TaO_x$, $AlO_x$, $ZrO_x$, $SiO_x$, or the like.

Further, in the second electrode 80, as described above, the thickness t1 of the second electrode 80 in the second area S2 is thicker than the thickness t2 of the second electrode 80 in the first area S1, and thus the stiffness of the second electrode 80 in the Z-axis direction in the second area S2 is higher than the stiffness of the second electrode 80 in the Z-axis direction in the first area S1.

Further, by configuring the second electrode 80 in the second area S2 with the first layer 81, the second layer 82, and the third layer 83, the stiffness in the Z-axis direction in the second area S2 is 17,000 N/m or more, and the length in the Z-axis direction in the second area S2 is made to be equal to or less than the length in the Z-axis direction of the piezoelectric body layer 70 in the second area S2.

As a result, when the piezoelectric actuator 300 is driven, the strain of the piezoelectric body layer 70 in the vicinity of the end portion 80*b* of the second electrode 80 is suppressed. That is, the strain of the piezoelectric body layer 70 in the vicinity of the boundary between the active portion 310 and the inactive portion 320 is suppressed. When a voltage is applied to the piezoelectric actuator 300, strain occurs in the active portion 310 on the outside of the pressure chamber 12, but since the second electrode 80 in the second area S2 has the above configuration, the strain which occurs in the active portion 310 is suppressed.

Accordingly, it is possible to suppress the occurrence of defects such as cracks and burnout of the piezoelectric body layer 70 in the vicinity of the boundary between the active portion 310 and the inactive portion 320 of the piezoelectric actuator 300. In particular, the second electrode 80 in the second area S2 is configured to include the second layer 82 formed of an insulator such as $TiO_x$, so that the second electrode 80 functions more effectively as a structure which reinforces the piezoelectric body layer 70. Accordingly, it is possible to more reliably suppress the occurrence of defects in the vicinity of the boundary between the active portion 310 and the inactive portion 320 of the piezoelectric actuator 300.

The stiffness of the second electrode 80 in the second area S2 in the Z-axis direction may be 17,000 N/m or more as described above, but is more preferably 22,000 N/m or more. By setting the stiffness of the second electrode 80 in the second area S2 in the Z-axis direction to 22,000 N/m or more, the strain of the active portion 310 is further suppressed within an appropriate range. Accordingly, defects such as cracks in the piezoelectric body layer 70 can be more reliably suppressed.

Further, the length of the second electrode 80 in the Z-axis direction in the second area S2 is shorter than the length of the piezoelectric body layer 70 in the Z-axis direction in the second area S2. That is, as illustrated in FIG. 4, the thickness t1 of the second electrode 80 in the second area S2 is thinner than a thickness t3 of the piezoelectric body layer 70 in the second area S2. As a result, since the second electrode 80 can be processed with high accuracy, the stiffness of the second electrode 80 in the Z-axis direction in the second area S2 can be adjusted to a desired value relatively easily. Accordingly, the strain of the active portion 310 in the second area S2 is suppressed more appropriately.

As described above, the second electrode 80 in the first area S1 does not include the second layer 82 and is constituted with the first layer 81 and the third layer 83, and the thickness t3 thereof is thinner than the thickness t1 of the second electrode 80 in the second area S2. Accordingly, the stiffness of the second electrode 80 in the Z-axis direction in the first area S1 is lower than the stiffness in the second area S2. Accordingly, an excessive decrease in the amount of deformation of the piezoelectric actuator 300 in the driving area is also suppressed.

Further, the stiffness of the second electrode 80 in the Z-axis direction in the second area S2 can be adjusted by adjusting the material and thickness of the first layer 81, the second layer 82, and the third layer 83. In particular, by changing the thickness of the second layer 82 formed of an insulator or the like, the stiffness of the second electrode 80 in the Z-axis direction in the second area S2 can be adjusted relatively easily.

In the present embodiment, the configuration in which the second electrode 80 has a plurality of layers of the first layer 81, the second layer 82, and the third layer 83 is illustrated, but the configuration of the second electrode 80 is not particularly limited. The second electrode 80 may be constituted with only one layer made of a conductive material, or may be configured to have a plurality of layers of four or more layers. Further, in the present embodiment, a configuration is illustrated in which in the second electrode 80 of the second area S2, the second layer 82 made of an insulator is provided between the first layer 81 and the third layer 83 formed of the conductive material, but the second layer may not be pinched between the first layer 81 and the third layer 83. Each layer of the second electrode 80 may be stacked in the order of the first layer 81, the third layer 83, and the second layer 82 from the side of the piezoelectric body layer 70, for example.

Figure 7:
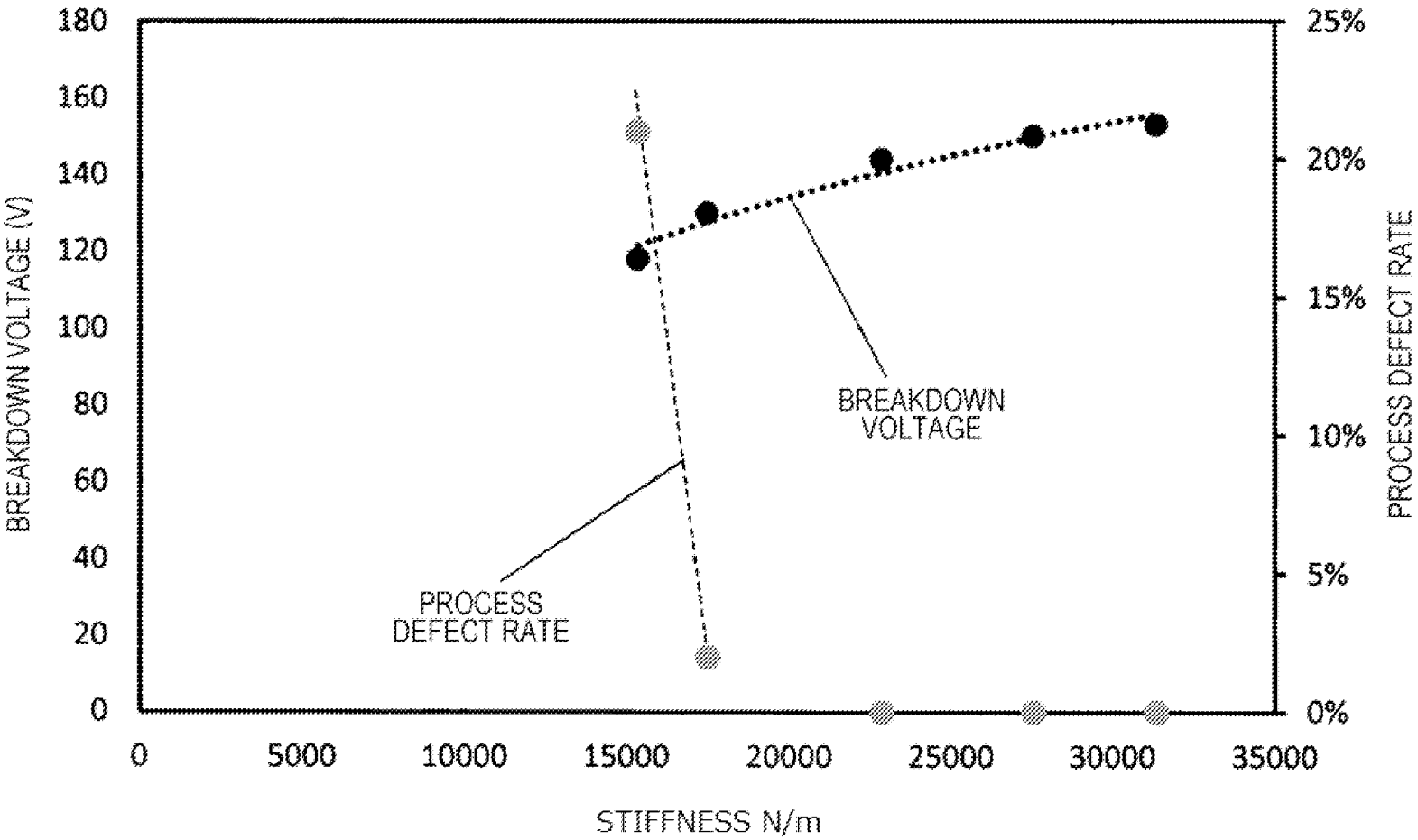
FIG. 7 is a graph illustrating the relationship between the stiffness of the second electrode, a breakdown voltage, and a process defect rate.

Here, a plurality of samples in which the stiffness of the second electrode 80 is different in the Z-axis direction in the second area S2 are prepared, and for each sample, the graph of FIG. 7 illustrates the result of investigating the relationship between the stiffness of the second electrode 80 in the Z-axis direction in the second area S2, and the breakdown voltage at which cracks or the like occur in the piezoelectric body layer 70 and the process defect rate which is the occurrence rate of defective products during production.

As can be seen from the graph illustrated in FIG. 7, when the stiffness of the second electrode 80 is approximately 17,000 (17,490) N/m or more, the breakdown voltage is relatively high at approximately 130 V or more. In particular, when the stiffness is approximately 22,000 (22,870) N/m or more, the breakdown voltage is as high as approximately 145 V or more, and defective products did not occur.

The process defect rate inspection is an inspection in which the piezoelectric device is applied with a voltage equal to or higher than the voltage which is normally used, and one among piezoelectric devices having a high possibility of being destroyed in a short period of time after the start of use, is revealed. In the inspection of the process defect rate carried out, a voltage equal to or higher than the voltage for ejecting ink droplets is applied to a liquid ejecting head, which is a piezoelectric device, and one having a high possibility of being destroyed in a short period of time after the start of use is revealed. In this inspection, a voltage of less than 145 V is applied to the liquid ejecting head.

Then, as illustrated in FIG. 7, it is found that when the stiffness is approximately 17,000 N/m or more, the process defect rate sharply decreases. That is, it is found that when the stiffness is approximately 17,000 N/m or more, the rate of defective products sharply decreases although a voltage equal to or higher than the voltage which is normally used is applied to the liquid ejecting head.

From the above, it can be judged that by making the stiffness of the second electrode 80 in the Z-axis direction in the second area S2 to be 17,000 N/m or more, preferably 22,000 N/m or more, the defect of the piezoelectric body layer 70 caused by repeated driving of the piezoelectric actuator 300 can be effectively suppressed.

On the other hand, as illustrated in FIGS. 2 and 4, on the outside of the end portion 80*b* of the second electrode 80 in the −X direction, that is, further on the side of the −X direction of the end portion 80*b* of the second electrode 80, a wiring portion 85 that is formed of the same layer as the second electrode 80 but is electrically discontinuous with the second electrode 80, is provided. In the present embodiment, the wiring portion 85 is constituted with the first layer 81 and the third layer 83, similarly to the first area S1. Further, the wiring portion 85 is formed over from the top of the piezoelectric body layer 70 to the top of the first electrode 60 extending further in the −X direction than the piezoelectric body layer 70 in a state in which an interval is spaced not to be in contact with the end portion 80*b* of the second electrode 80 in the −X direction. The wiring portion 85 is provided independently for each of the active portions 310. That is, a plurality of wiring portions 85 are disposed at a predetermined interval along the Y-axis direction. The wiring portion 85 may be formed of a layer different from that of the second electrode 80, but is preferably formed of the same layer as the second electrode 80. As a result, the manufacturing step of the wiring portion 85 can be simplified and the cost can be reduced.

Further, an individual lead electrode 91 and a common lead electrode 92, which is a common driving electrode, are coupled to the first electrode 60 and the second electrode 80 that constitute the piezoelectric actuator 300, respectively. The flexible wiring substrate 120 is coupled to an end portion on the opposite side of the end portions of the individual lead electrode 91 and the common lead electrode 92 coupled to the piezoelectric actuator 300. In the present embodiment, the individual lead electrode 91 and the common lead electrode 92 are extended to be exposed in a through hole 32 formed in the protective substrate 30, and are electrically coupled to the wiring substrate 120 in the through hole 32. A drive circuit 121 having a switching element for driving the piezoelectric actuator 300 is mounted on the wiring substrate 120.

In the present embodiment, the individual lead electrode 91 and the common lead electrode 92 are made of the same layer, but are formed to be electrically discontinuous. As a result, the manufacturing step can be simplified and the cost can be reduced as compared to when the individual lead electrode 91 and the common lead electrode 92 are individually formed. Of course, the individual lead electrode 91 and the common lead electrode 92 may be formed of different layers.

The material of the individual lead electrode 91 and the common lead electrode 92 is not particularly limited as long as it is a conductive material, and for example, gold (Au), platinum (Pt), aluminum (Al), copper (Cu) or the like can be used. In the present embodiment, gold (Au) is used as the individual lead electrode 91 and the common lead electrode 92. Further, the individual lead electrode 91 and the common lead electrode 92 may have an adhesion layer for improving the adhesion with the first electrode 60, the second electrode 80, and the diaphragm 50.

The individual lead electrode 91 is provided for each active portion 310, that is, for each first electrode 60. The individual lead electrode 91, as illustrated in FIGS. 2 and 4, is coupled to the vicinity of the end portion 60*b* of the first electrode 60 in the −X direction provided on the outside of the piezoelectric body layer 70 via the wiring portion 85, and is drawn out on the top of the flow path forming substrate 10, actually to the top of the diaphragm 50 in the −X direction.

On the other hand, as illustrated in FIGS. 2 and 4, the common lead electrode 92 is drawn out in the −X direction from the top of the second electrode 80 constituting the common electrode on the piezoelectric body layer 70 to the top of the diaphragm 50, at both end portions in the Y-axis direction. Further, the common lead electrode 92 has an extension portion 93 as a third electrode extending along the Y-axis direction in an area corresponding to the end portion 12*b* of the pressure chamber 12 on the side of the −X direction. Further, in the present embodiment, the common lead electrode 92 includes an extension portion 94 extending along the Y-axis direction in an area corresponding to the end portion 12*a* of the pressure chamber 12 on the side of the +X direction. These extension portions 93 and 94 are continuously provided in the Y-axis direction with respect to the plurality of active portions 310. As described above, the common lead electrode 92 is drawn out at both end portions thereof in the Y-axis direction, to the top of the diaphragm 50 in the −X direction.

Further, the extension portion 93, which is the third electrode, extends from the inside of the pressure chamber 12 to the vicinity of the end portion 80*b* of the second electrode 80 in the −X direction on the outside of the pressure chamber 12. In the present embodiment, the active portions 310 of the piezoelectric actuator 300 extend to the outside of the pressure chamber 12 beyond the end portion 12*b* of the pressure chamber 12 in the −X direction, and the extension portion 93 extends to the outside of the pressure chamber 12 on the top of the active portion 310.

Here, the extension portion 93 as the third electrode extends to the vicinity of the end portion 80*b* of the second electrode 80 in the present embodiment. That is, the extension portion 93 extends to the second area S2. Since the extension portion 93 extends to the second area S2, the strain of the active portion 310 is further suppressed by the extension portion 93 together with the second electrode 80 described above. Accordingly, defects such as the occurrence of cracks in the piezoelectric body layer 70 can be more reliably suppressed.

However, the extension portion 93, which is the third electrode, is provided at a portion other than the end portion 80*b* of the second electrode 80. When the extension portion 93, which is the common lead electrode 92, is provided at the end portion 80*b* of the second electrode 80, for example, there is a risk of the occurrence of leakage current when the adhesion layer of the common lead electrode 92 formed of nichrome, titanium tungsten, or the like is in contact with the piezoelectric body layer 70. Accordingly, it is preferable that the extension portion 93 does not extend to the end portion 80*b* of the second electrode 80 in the second area S2. That is, it is preferable that the end portion of the extension portion 93 on the side of the −X direction does not coincide with the end portion 80*b* of the second electrode 80 and is positioned more inside compared to the end portion 80*b*.

Further, in this case, in the second area S2, the electrical conductivity of the extension portion 93 as the third electrode is preferably higher than the electrical conductivity of the second electrode 80. Further, in the second area S2, the length of the extension portion 93 as the third electrode in the Z-axis direction is preferably longer than the length of the second electrode 80 in the Z-axis direction. As illustrated in FIG. 4, in the second area S2, it is preferable that a thickness t4 of the extension portion 93 is thicker than the thickness t1 of the second electrode 80. With such a configuration, in the second area S2, the current easily flows in the portion in which the extension portion 93 of the second electrode 80 is formed, and the current flowing in the end portion 80*b* of the second electrode 80 is reduced. Accordingly, it is possible to further suppress the occurrence of defects such as cracks and burnout in the piezoelectric body layer 70 in the vicinity of the end portion 80*b* of the second electrode 80.

As described above, the ink jet recording head 1, which is a liquid ejecting head, which is an example of the piezoelectric device of the present embodiment, includes the flow path forming substrate 10 which is a substrate in which the pressure chambers 12 which are a plurality of recess portions are formed, the diaphragm 50 provided on the side of one surface of the flow path forming substrate, and the piezoelectric actuator 300 including the first electrode 60, the piezoelectric body layer 70, and the second electrode 80 which are stacked in the Z-axis direction which is the first direction on the side of a surface opposite to the flow path forming substrate 10 of the diaphragm 50. When one area far from the end portion 80*b* of the second electrode 80 is the first area S1 and one area near the end portion 80*b* of the second electrode 80 is the second area S2, of two areas of the second electrode 80 in the X-axis direction which is the second direction intersecting the Z-axis direction which is the first direction, the second electrode 80 has a stiffness of 17,000 N/m or more in the Z-axis direction in the second area S2, which is higher than the stiffness in the Z-axis direction in the first area S1, and the length thereof in the Z-axis direction in the second area S2 is equal to or less than the length of the piezoelectric body layer 70 in the second area S2 in the first direction.

With such a configuration, when the piezoelectric actuator 300 is driven, strain of the active portion 310 in the vicinity of the end portion 80*b* of the second electrode 80, that is, in the second area S2 is suppressed.

Accordingly, it is possible to suppress the occurrence of defects such as cracks and burnout of the piezoelectric body layer 70 in the vicinity of the boundary between the active portion 310 and the inactive portion 320 of the piezoelectric actuator 300.

Second Embodiment

Figure 8:
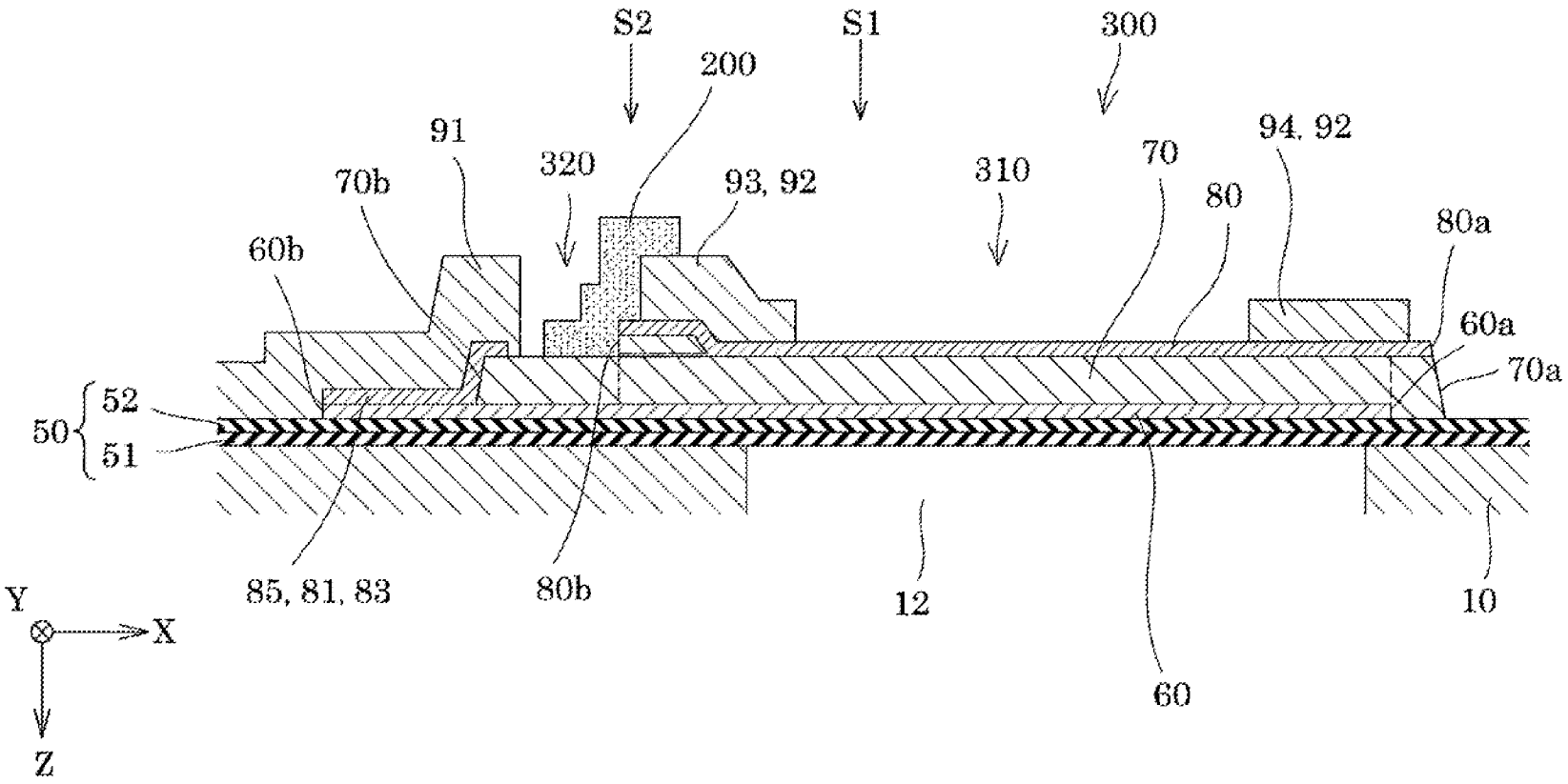
FIG. 8 is a sectional view of a main portion of a recording head according to a second embodiment.

FIG. 8 is a sectional view of an ink jet recording head which is an example of a liquid ejecting head according to a second embodiment of the present disclosure, and is an enlarged view illustrating the configuration of the piezoelectric actuator 300. The same members as those in the first embodiment are designated by the same reference numerals, and redundant descriptions will be omitted.

As illustrated in FIG. 8, the piezoelectric actuator 300 according to the present embodiment includes a protective film 200 provided on the side of the −Z direction of the second electrode 80, that is, the second electrode 80. The protective film 200 covers the end portion 80*b* of the second electrode 80 in the second area S2. That is, the protective film 200 is provided to cover the boundary portion between the active portion 310 and the inactive portion 320 of the piezoelectric actuator 300. The configuration other than the protective film 200 is similar to that of the first embodiment.

In the piezoelectric body layer 70 in the vicinity of the boundary between the active portion 310 and the inactive portion 320, for example, stress concentration may occur due to the non-uniform occurrence state of strain, and as a result, the occurrence of cracks or burnout due to this crack may be noticeable. However, in the present embodiment, since the protective film 200 is provided to cover the boundary portion between the active portion 310 and the inactive portion 320, the occurrence of cracks and burnout in this area can be more reliably reduced.

In the example illustrated in FIG. 8, the protective film 200 is provided only in the vicinity of the end portion 80*b* of the second electrode 80, but the range in which the protective film 200 is formed is not particularly limited. For example, the protective film 200 may be provided to cover the exposed portion of the surface of the piezoelectric body layer 70 of the inactive portion 320.

Further, the material of the protective film 200 is not particularly limited, but for example, an organic material such as polyimide (aromatic polyimide) can be used. Further, the protective film 200 may be formed of an epoxy-based adhesive or a silicon-based adhesive. Further, when the protective film 200 is formed by an adhesive, the adhesive for adhering the protective substrate 30 to the flow path forming substrate 10 may function as the protective film 200. That is, the protective substrate 30 may be adhered by an adhesive at a portion corresponding to the end portion 80*b* of the second electrode 80 of the flow path forming substrate 10, and the end portion 80*b* of the second electrode 80 may be covered with this adhesive.

Further, it is preferable that the Young's modulus of the protective film 200 is lower than the Young's modulus of the second electrode 80 in the second area S2. In the present embodiment, since the protective film 200 is formed of an organic material such as polyimide, the Young's modulus of the protective film 200 is lower than the Young's modulus of the second electrode 80 formed of a metal or the like such as iridium. As a result, the strain of the piezoelectric body layer 70 at the boundary portion between the active portion 310 and the inactive portion 320 is less likely to occur, and vibration is also more likely to be absorbed, and thus the occurrence of cracks and burnout can be reduced more reliably in this area.

Other Embodiments

Although each embodiment of the present disclosure has been described above, the basic configuration of the present disclosure is not limited to the above.

In the embodiment described above, the present disclosure has been described by taking the configuration in the vicinity of the end portion 80*b* of the second electrode 80 in the −Y direction as an example, but the present disclosure, of course, can also be applied to the vicinity of the end portion 80*b* of the second electrode 80 in the +Y direction. When the boundary portion between the active portion 310 and the inactive portion 320 of the piezoelectric actuator 300 defined by the end portion 80*a* of the second electrode 80 are present on the outside of the pressure chamber 12 in the +Y direction, the above-described configuration of the present disclosure can also be applied to the side of the end portion 80*a* of the second electrode 80 in the +Y the direction.

Further, in each of the embodiments described above, the first electrode 60 may constitute an individual electrode for each active portion 310, and the second electrode 80 constitutes a common electrode of the plurality of active portions 310, but the first electrode 60 may constitute the common electrode of the plurality of active portions 310, and the second electrode 80 may constitute the individual electrode for each active portion 310. Even in this case, a similar effect as that of the embodiment described above can be obtained.

Figure 9:
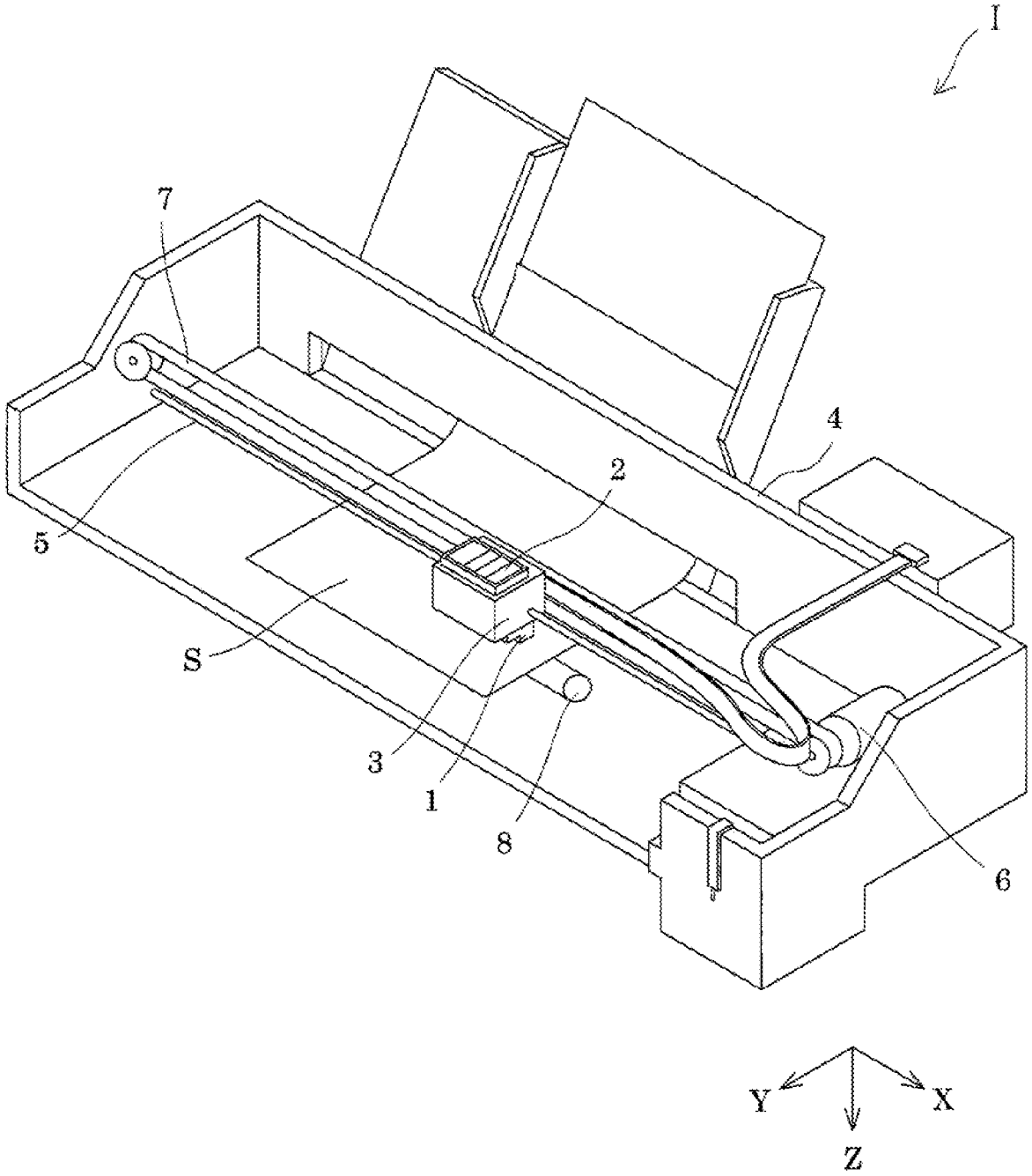
FIG. 9 is a diagram illustrating a schematic configuration of a recording apparatus according to an embodiment.

Further, the recording head 1 of each of these embodiments is mounted on an ink jet recording apparatus which is an example of a liquid ejecting apparatus. FIG. 9 is a schematic view illustrating an example of an ink jet recording apparatus which is an example of a liquid ejecting apparatus according to an embodiment.

In the ink jet recording apparatus I illustrated in FIG. 9, the recording head 1 is provided with a detachable cartridge 2 constituting an ink supply unit, and is mounted on a carriage 3. The carriage 3 on which the recording head 1 is mounted is provided to be movable in the axial direction of a carriage shaft 5 attached to an apparatus main body 4.

Then, the driving force of a drive motor 6 is transmitted to the carriage 3 via a plurality of gears (not illustrated) and a timing belt 7, so that the carriage 3 mounted with the recording head 1 is moved along the carriage shaft 5. On the other hand, the apparatus main body 4 is provided with a transport roller 8 as a transport unit, and a recording sheet S, which is a recording medium such as paper, is transported by the transport roller 8. The transport unit for transporting the recording sheet S is not limited to the transport roller, and may be a belt, a drum, or the like.

In such an ink jet recording apparatus I, when the recording sheet S is transported in the +X direction with respect to the recording head 1, and the carriage 3 is reciprocated in the Y direction with respect to the recording sheet S, by ejecting ink droplets from the recording head 1, the landing of ink droplets, so-called printing is performed over substantially the entire surface of the recording sheet S.

Further, in the ink jet recording apparatus I described above, an example is described in which the recording head 1 is mounted on the carriage 3 and reciprocates in the Y direction, which is the main scanning direction, but the present disclosure is not particularly limited thereto, and for example, the present disclosure can also be applied to a so-called line-type recording apparatus in which printing is performed simply by fixing the recording head 1 and moving the recording sheet S such as paper in the X direction, which is the sub scanning direction.

In the above embodiment, an ink jet recording head has been described as an example of the liquid ejecting head, and an ink jet recording apparatus has been described as an example of the liquid ejecting apparatus, but the present disclosure is intended for a wide range of liquid ejecting heads and liquid ejecting apparatuses in general, and of course, can be also applied to a liquid ejecting head and a liquid ejecting apparatus that eject a liquid other than ink. Other liquid ejecting heads include, for example, various recording heads used in an image recording apparatus such as a printer, a color material ejecting head used in manufacturing a color filter such as a liquid crystal display, an electrode material ejecting head used for forming an electrode such as an organic EL display and a field emission display (FED), a bioorganic substance ejecting head used for manufacturing a biochip, or the like, and the present disclosure can also be applied to a liquid ejecting apparatus provided with such a liquid ejecting head.

Further, the present disclosure is applied not only to a liquid ejecting head typified by an ink jet recording head, but also to other piezoelectric devices such as an ultrasonic device such as an ultrasonic transmitter, an ultrasonic motor, a pressure sensor, and a pyroelectric sensor.

What is claimed is:

1. A piezoelectric device comprising:

a substrate on which a plurality of recess portions are formed;

a diaphragm provided on a side of one surface of the substrate; and a piezoelectric actuator having a first electrode, a piezoelectric body layer, and a second electrode which are stacked in a first direction on a side of a surface opposite to the substrate of the diaphragm, wherein when one area far from an end portion of the second electrode is a first area and one area near the end portion of the second electrode is a second area, of two areas of the second electrode in a second direction intersecting the first direction, the second electrode has a stiffness of 17,000 N/m or more in the second area in the first direction, which is higher than a stiffness in the first area in the first direction, and a length in the second area in the first direction is equal to or less than a length of the piezoelectric body layer in the second area in the first direction, wherein the second electrode in the second area has a first layer and a second layer, the first layer is disposed between the second layer and the piezoelectric body layer in the first direction, and the second layer has a lower electrical conductivity than the first layer, and the second electrode in the first area has the first layer and does not have the second layer.

2. The piezoelectric device according to claim 1, wherein a stiffness of the second electrode in the second area in the first direction is 22,000 N/m or more.

3. The piezoelectric device according to claim 1, wherein the first area is in a driving area in which the diaphragm is in contact with the recess portion, and the second area is in a non-driving area in which the diaphragm is not in contact with the recess portion.

4. The piezoelectric device according to claim 1, wherein the second electrode in the second area further has a third layer which has a higher electrical conductivity than the second layer, and the first layer, the second layer, and the third layer, are disposed in this order in the first direction in the second area, and the second electrode in the first area has the third layer.

5. The piezoelectric device according to claim 1, wherein a third electrode that is continuously provided in the first direction with respect to the second electrode is provided, and in the second area, the third electrode is provided in a portion other than the end portion of the second electrode.

6. The piezoelectric device according to claim 5, wherein in the second area, an electrical conductivity of the third electrode is higher than an electrical conductivity of the second electrode.

7. The piezoelectric device according to claim 5, wherein in the second area, a length of the third electrode in the first direction is longer than a length of the second electrode in the first direction.

8. The piezoelectric device according to claim 1, wherein the end portion of the second electrode in the second area is covered with a protective film.

9. The piezoelectric device according to claim 8, wherein a Young's modulus of the protective film is lower than a Young's modulus of the second electrode.

10. A liquid ejecting head comprising:

a substrate on which a plurality of recess portions are formed;

a diaphragm provided on a side of one surface of the substrate; and a piezoelectric actuator having a first electrode, a piezoelectric body layer, and a second electrode which are stacked in a first direction on a side of a surface opposite to the substrate of the diaphragm, wherein when one area far from an end portion of the second electrode is a first area and one area near the end portion of the second electrode is a second area, of two areas of the second electrode in a second direction intersecting the first direction, the second electrode has a stiffness of 17,000 N/m or more in the second area in the first direction, which is higher than a stiffness in the first area in the first direction, and a length in the second area in the first direction is equal to or less than a length of the piezoelectric body layer in the second area in the first direction, wherein the second electrode in the second area has a first layer and a second layer, the first layer is disposed between the second layer and the piezoelectric body layer in the first direction, and the second layer has a lower electrical conductivity than the first layer, and the second electrode in the first area has the first layer and does not have the second layer.

11. A liquid ejecting apparatus comprising the liquid ejecting head according to claim 10.

* * * * *